US007248216B2

(12) United States Patent
Akiyama et al.

(10) Patent No.: US 7,248,216 B2
(45) Date of Patent: Jul. 24, 2007

(54) CALIBRATION APPARATUS AND METHOD FOR ARRAY ANTENNA

(75) Inventors: Chiyoshi Akiyama, Kawasaki (JP); Toshio Kawasaki, Kawasaki (JP); Tomonori Sato, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 116 days.

(21) Appl. No.: 11/235,052

(22) Filed: Sep. 27, 2005

(65) Prior Publication Data

US 2006/0279459 A1 Dec. 14, 2006

(30) Foreign Application Priority Data

Jun. 10, 2005 (JP) ..... 2005-170886

(51) Int. Cl.
*H01Q 3/00* (2006.01)

(52) U.S. Cl. ..... 342/368; 342/372

(58) Field of Classification Search ..... 342/368, 342/372

See application file for complete search history.

(56) References Cited

U.S. PATENT DOCUMENTS 5,412,414 A 5/1995 Ast et al.
5,936,569 A * 8/1999 St.ang.hle et al. ..... 342/174
6,339,399 B1 * 1/2002 Andersson et al. ..... 342/372
6,720,919 B1 * 4/2004 Sinsky et al. ..... 342/368
7,106,249 B2 * 9/2006 Kubo et al. ..... 342/174
2001/0005685 A1 6/2001 Nishimara et al.
2004/0063469 A1 4/2004 Kuwahara et al.

FOREIGN PATENT DOCUMENTS

EP 1 294 047 3/2003
EP 1 389 837 2/2004
JP 2004-297694 10/2004

* cited by examiner

*Primary Examiner*—Gregory C. Issing
(74) *Attorney, Agent, or Firm*—Bingham McCutchen LLP

(57) ABSTRACT

The present invention relates to a calibration apparatus for an array antenna having a plurality of antenna elements. The calibration apparatus comprises a conversion unit detecting a calibration signal from an output of a transmission unit to convert the detected calibration signal into a predetermined reception radio frequency and outputting the converted calibration signal together with a reception main signal to a reception unit, a detecting unit detecting the calibration signal from an output of the reception unit for each of the antenna elements to obtain a relative phase difference between the calibration signals, and a phase correcting unit correcting a phase difference with respect to one of or both a transmission main signal and a reception main signal based on the obtained relative phase difference. This configuration can eliminate the need for a radio transmitter-receiver dedicated to a calibration signal, thus facilitating the calibrations.

18 Claims, 10 Drawing Sheets

CALIBRATION APPARATUS AND METHOD FOR ARRAY ANTENNA

CROSS REFERENCE TO RELATED APPLICATIONS

This application is based on hereby claims priority to Japanese Application No. 2005-170886 filed on Jun. 10, 2005 in Japan, the contents of which are hereby incorporated by reference.

BACKGROUND OF THE INVENTION (1) Field of the Invention

The present invention relates to a calibration apparatus and method for an array antenna.

(2) Description of the Related Art

Recent communication systems, represented by CDMA (Code Division Multiple Access), require larger capacity and higher speed, and an array antenna is employed as a means to realize these requirements. That is, the CDMA system is based on an access mode in which channels are allocated through the use of codes to carry out simultaneous communications, while interference with signals from other channels under the simultaneous communication condition occurs, which consequently limits the number of simultaneously communicable channels, i.e., the channel capacity. An array antenna, particularly an adaptive array antenna, is employed for the purpose of enhancing this channel capacity.

The adaptive array antenna adaptively forms a beam according to an environment for a user, who wants to do, and forms a null to a user who becomes a source of large interference, and is a technique capable of increasing the channel capacity. That is, it forms a beam in a direction of the user who wants to do and directs a null toward the user who becomes a source of large interference so as to receive radio waves with high sensitivity from the user who wants to do, but never to receive radio waves from the large interference source. This can reduce the amount of interference, which results in an increase in channel capacity.

Meanwhile, the adaptive array antenna is designed to produce a beam through the use of a phase difference at antenna terminal portions. For this reason, when a phase variation occurs at radio portions, proper control of beam pattern becomes impossible. Accordingly, the proper control of the beam pattern requires a correction of the phase difference at antenna terminal portions, and the calibration between antenna elements is of the essence.

FIG. 10 is an illustration for explaining a calibration method for a reception system of an array antenna, and corresponds to FIG. 1 of Japanese Patent Laid-Open No. 2004-297694. An array antenna system (reception system) as shown in FIG. 10 is comprised of an array antenna unit 100 including a plurality of (four) antenna elements Ant1, Ant2, Ant3 and Ant4, switches 101 each provided for each of the antenna elements Ant1, Ant2, Ant3 and Ant4, array radio receivers (RXs) 102, timing detectors 104, multipliers 106 and 108, an adder 110, an adaptive controller 112, a reference signal memory 114 and a calibration signal memory 116 serving as a radio transmitter dedicated to a calibration signal.

In this array antenna system, calibration signals read out from the calibration signal memory 116 are inputted through the array radio receivers 102 and the timing detectors 104 to the multipliers 106 and the adaptive controller 112. The multipliers 106 weights the output signals from the timing detector 104 with correction weight coefficients $W_{01}$, $W_{02}$, $W_{03}$ and $W_{04}$. The adaptive controller 112 calculates the aforesaid correction weight coefficients $W_{01}$, $W_{02}$, $W_{03}$ and $W_{04}$ on the basis of output signals from the timing detectors 104, a reference signal from the reference signal memory 114 and output signals from the multipliers 106 according to an adaptive algorithm based on the least-square error method. Thus, the array antenna system itself can carry out the calibration, which reduces the system scale at the calibration.

However, the above-described calibration method requires the radio transmitter 116 dedicated to a calibration signal for the calibration of a reception system, and requires a radio receiver dedicated to a calibration signal for the calibration of a transmission system. In addition, since the calibrations of the transmission system and the reception system are made separately, a transmitter-receiver dedicated to a calibration signal becomes necessary for both the transmission and reception calibrations. This dedicated transmitter-receiver is a redundant radio apparatus which is not used in actual operations, and the presence of this radio apparatus causes an enlargement in apparatus scale and circuit scale and entails an increase in dissipation power and cost.

SUMMARY OF THE INVENTION

The present invention has been developed in consideration of these problems, and it is therefore an object of the invention to facilitate calibrations without requiring a radio transmitter-receiver dedicated to a calibration signal.

For this purpose, the present invention provides the following calibration apparatus and method for an array antenna.

(1) In accordance with an aspect of the present invention, there is provided a calibration apparatus for an array antenna having a plurality of antenna elements, comprising calibration signal producing means for producing a calibration signal for each of the antenna elements, transmission means for outputting, to the corresponding antenna element, the calibration signal produced by the calibration signal producing means together with a transmission main signal at a predetermined transmission radio frequency, reception means for receiving a reception main signal with a predetermined reception radio frequency from the antenna element, calibration signal detection/frequency conversion means for detecting the calibration signal from the output of the transmission means to convert the detected calibration signal into a predetermined reception radio frequency and for outputting the converted calibration signal together with the reception main signal to the reception means, relative phase difference detecting means for detecting the calibration signal from an output of the reception means for each antenna element to obtain a relative phase difference between the calibration signals, and phase correcting means for correcting a phase difference with respect to one of or both the transmission main signal and the reception main signal on the basis of the relative phase difference obtained by the relative phase difference detecting means.

(2) In this case, it is also appropriate that the calibration signal producing means includes calibration signal producing units each provided for each antenna element for producing the calibration signal for each antenna element, and the transmission means includes adders each provided for each antenna element for adding the calibration signal produced in each of the calibration signal producing units to the transmission main signal for each antenna element and radio transmitters each provided for each antenna element for frequency-converting an output of each of the adders into the transmission radio frequency to output it as a transmission signal to the antenna element, and the calibration signal detection/frequency conversion means includes a branch unit for taking out a portion of the transmission signal directed at the antenna element, a first calibration signal detecting unit for detecting the calibration signal from the transmission signal taken out by the branch unit, a frequency converter for converting the calibration signal detected by the first calibration signal detecting unit into the reception radio frequency, and a coupling unit for coupling the calibration signal frequency-converted by the frequency converter with the reception main signal from the antenna element to the reception means.

(3) In addition, it is also appropriate that the calibration signal producing means includes a common calibration signal producing unit for producing the calibration signal in common with respect to the antenna elements, and the transmission means includes adders each provided for each antenna element for adding the calibration signal to the transmission main signal for each antenna element, a calibration signal selective-outputting unit for selectively outputting the calibration signal produced in the common calibration signal producing unit to one of the adders, and radio transmitters each provided for each antenna element for frequency-converting an output of each of the adders into the transmission radio frequency to output it as a transmission signal to the antenna element.

(4) Still additionally, it is also appropriate that the relative phase difference detecting means includes second calibration signal detecting units each provided for each antenna element for detecting the calibration signal from an output of the reception means for each antenna element, phase detecting units each provided for each antenna element for detecting a phase of each of the calibration signals detected by the second calibration signal detecting units, and a relative phase difference detecting unit for detecting the relative phase difference between the calibration signals on the basis of a result of the detection in each of the phase detecting units.

(5) Yet additionally, it is also appropriate that the calibration signal producing means includes a time-division calibration signal producing unit for producing the calibration signal for each antenna element in a time division fashion, and the transmission means includes an adder for adding the calibration signal produced in the time-division calibration signal producing unit to the transmission main signal for each antenna element, radio transmitters each provided for each antenna element for frequency-converting a frequency of an inputted signal into the transmission radio frequency to output it as a transmission signal to the antenna element, and a time-division demultiplexing unit for demultiplexing the output of the adder for each antenna element to distribute them to the radio transmitters.

(6) Moreover, it is also appropriate that the relative phase difference detecting means includes a time-division multiplexing unit for time-division-multiplexing the output of the reception means for each antenna element, a time-division calibration signal detecting unit for detecting the calibration signal from the output of the time-division multiplexing unit for each antenna element in a time division fashion, a time-division phase detecting unit for detecting a phase of each of the calibration signals detected by the time-division calibration signal detecting unit in a time-division fashion, and a time-division relative phase difference detecting unit for detecting the relative phase difference between the calibration signals on the basis of a result of each detection by the time-division phase detecting unit in a time division fashion.

(7) Still moreover, it is also appropriate that the calibration signal producing means produces a fixed value as the calibration signal.

(8) Yet moreover, it is also appropriate that the calibration signal producing means produces a sine wave as the calibration signal.

(9) In addition, it is also appropriate that the calibration signal producing means produces a spread spectrum signal as the calibration signal.

(10) Furthermore, in accordance with a further aspect of the present invention, there is provided a calibration method for an array antenna having a plurality of antenna elements, comprising the steps of producing a calibration signal for each of the antenna elements, outputting, to the antenna element, the produced calibration signal together with a transmission main signal at a predetermined transmission radio frequency, detecting the calibration signal from a signal directed at the antenna element and converting it into a predetermined reception radio frequency to output the converted calibration signal together with a reception main signal from the antenna element to reception means, detecting the calibration signal from an output of the reception means for each antenna element to obtain a relative phase difference between the calibration signals, and correcting a phase difference with respect to one of or both the transmission main signal and the reception main signal on the basis of the obtained relative phase difference.

The present invention described above can provide the following effects and advantages.

(1) Since a calibration signal is detected from an output of the transmission means to be converted into a reception radio frequency and outputted together with a reception main signal to the reception means while a calibration signal is detected from an output of this reception means for each antenna element to obtain a relative phase difference between the calibration signals so that, with respect to one of or both the transmission main signal to the antenna element and the reception main signal from the antenna element, a phase difference is corrected on the basis of the relative phase difference obtained in this way, the calibrations on the transmission system and reception system of the array antenna are realizable with the same arrangement. Therefore, unlike the prior technique, the necessary calibration can be made easy without requiring a radio transmitter-receiver dedicated to the calibration, which achieves the size reduction of the apparatus configuration and contributes greatly to the cost reduction.

(2) In addition, when a common calibration signal for respective antenna elements is selectively added to (superimposed on) a transmission main signal directed at each of the antenna elements, a calibration signal producing unit can be made in common with respect to the respective antenna elements, which can further reduce the apparatus scale and cost.

(3) Still additionally, when a calibration signal is produced in a time division fashion so that the phase of each of the calibration signals and the relative phase difference between the calibration signals are detected in a time division fashion, the calibration is flexibly realizable with a common configuration without depending upon an arrangement (reception diversity, transmission diversity, transmission and reception diversity, and others) or the number of antenna elements, which can further reduce the apparatus scale and cost.

(4) Yet additionally, since the above-described arrangement does not depend upon communication modes, it is also applicable to signals in various types of multiple access systems such as FDMA (Frequency Division Multiple Access), TDMA (Time Division Multiple Access) and CDMA (Code Division Multiple Access) and multicarrier transmission systems such as OFDM (Orthogonal Frequency Division Multiplexing).

(5) Moreover, when a spread spectrum signal (in particular, spread spectrum signal spread with a different spread code according to antenna element) is produced as a calibration signal, the diffusion code enables the calibration signal to be identified for each antenna element so that the calibration signal can be set in an outputted condition at all times, which can eliminate the need for the complicated calibration timing control, such as in time division systems.

DESCRIPTION OF THE PREFERRED EMBODIMENTS

[A] Description of Basic Principle

Figure 1:
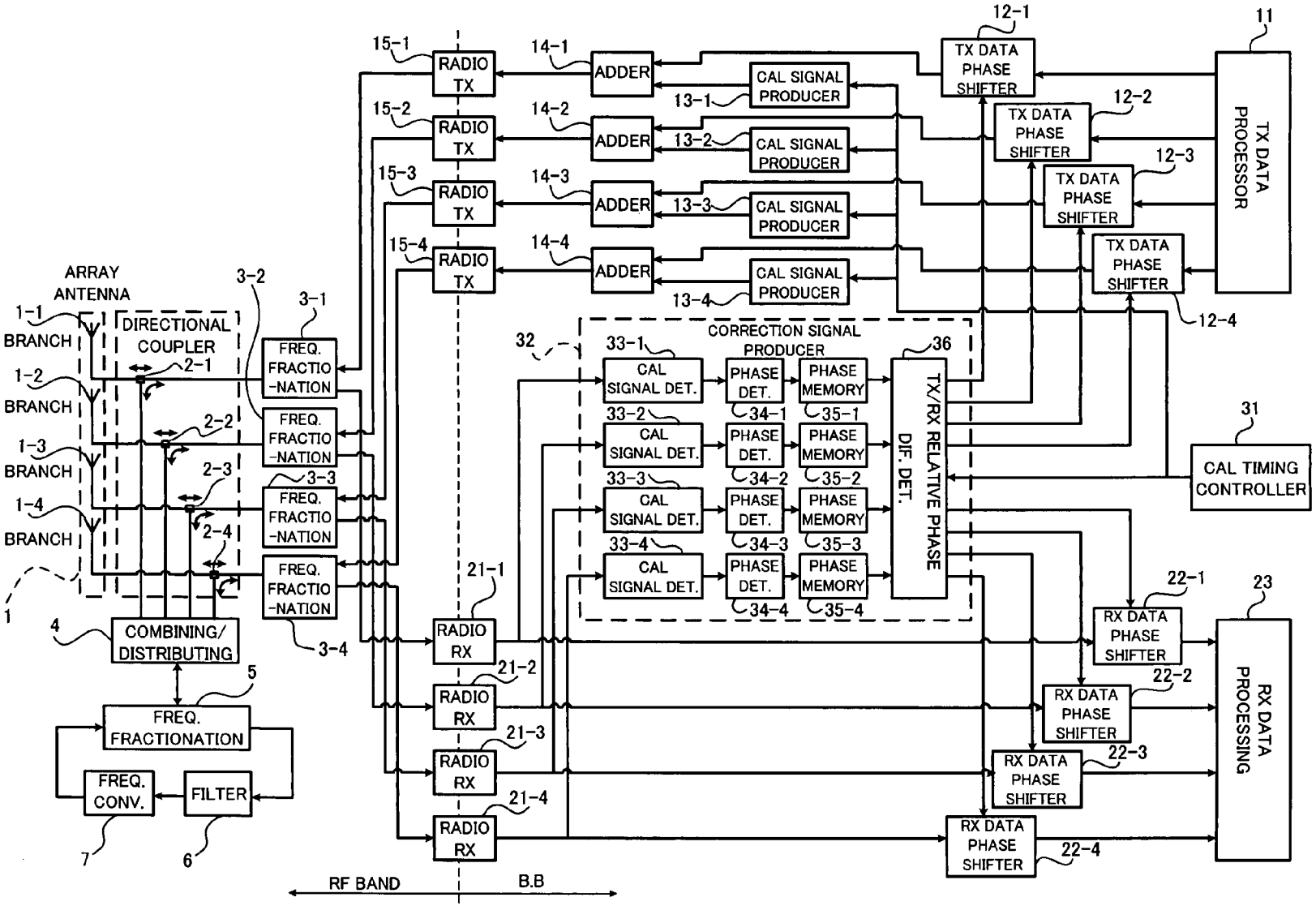
FIG. 1 is a block diagram showing a configuration of an array antenna communication system for explaining a basic principle of the present invention.

FIG. 1 is a block diagram showing a configuration of an array antenna communication system for explaining a basic principle of the present invention. The system shown in FIG. 1 includes, as a transmission/reception shared section, an array antenna 1 having a plurality of (for example, four) antenna elements (branch antennas) 1-1 to 1-N, directional couplers 2-1 to 2-N and frequency fractionation units 3-1 to 3-N provided in corresponding relation to the respective branch antennas 1-*i* (i=1 to N), a combining/distributing unit 4, a frequency fractionation unit 5, a filter 6 and a frequency converter 7, and includes, as a transmission system, transmission (TX) data processor 11 and transmission data phase shifters 12-1 to 12-N, calibration signal producers 13-1 to 13-N, adders 14-1 to 14-N and radio transmitters(TXs) 15-1 to 15-N provided in corresponding relation to the branch antennas 1-*i*, and further includes, as a reception system, radio receivers (RXs) 21-1 to 21-N and reception (RX) data phase shifters 22-1 to 22-N provided in corresponding relation the branch antennas 1-*i* and reception(RX) data processor 23. In addition, as a calibration controller system, there are included a calibration timing controller 31 and a correction signal producer 32 made up of calibration signal detectors 33-1 to 33-N, phase detectors 34-1 to 34-N, phase memories 35-l to 35-N and transmission-system/reception-system (TX/RX) relative phase difference detector 36.

In this configuration, in the transmission system, the transmission data processor 11 is for carrying out necessary transmission processing on transmission data (transmission main signal) for each branch antenna 1-*i*, and each of the transmission data phase shifters 12-*i* is for adjusting the phase of the transmission data, supplied from the transmission data processor 11 for each branch antenna 1-*i*, in accordance with a correction signal (phase adjustment signal) from the correction signal producer 32, and each of the calibration signal producer (calibration signal producing means) 13-*i* is for producing and outputting a necessary calibration signal for each branch antenna 1-*i* under timing control of the calibration timing controller 31.

Each of the adders 14-*i* is for adding (superimposing) the calibration signal, produced by the calibration signal producer 13-*i*, to the transmission data after the phase adjustment by the transmission data phase sifter 12-*i*, and each of the radio transmitters 15-*i* has a function to carry out a frequency conversion (up-conversion) of the transmission data, to which the calibration signal is added by the adder 14-*i*, into a transmission radio frequency.

That is, the block composed of the transmission data processor 11, the transmission data phase sifters 12-*i*, the adders 14-*i* and the radio transmitters 15-*i* functions as transmission means to output calibration signal, produced in the calibration signal producer 13-*i*, together with transmission main signal directed at the branch antenna 1-*i*, to the branch antenna 1-*i* at a predetermined transmission radio frequency.

Moreover, in the transmission/reception shared section, each of frequency fractionation units 3-*i* is made to sort out the frequency of an inputted signal for outputting a signal with a transmission radio frequency to the array antenna 1 side and further to output a signal with a reception radio frequency from the array antenna 1 side to the radio receiver 21-*i*, and each of the directional couplers (branch units, coupling units) 2-*i* is made to take out a portion of a transmission signal from the frequency fractionation unit 3-*i* to the branch antenna (hereinafter referred to simply as "branch") 1-*i* for outputting (branch) it to the combining/distributing unit 4, and further to couple a signal from the combining/distributing unit 4 with a reception main signal at the branch antenna 1-*i* for outputting the resultant signal to the frequency fractionation unit 3-*i* side.

The combining/distributing unit 4 is designed to combine transmission signals from the respective directional couplers 2-*i* and further to distribute a signal from the frequency fractionation unit 5 to the respective directional couplers 2-*i*, and the frequency fractionation unit 5 is designed to sort out the frequencies of inputted signals for outputting signals with transmission radio frequencies to the filter 6 and further for a signal with a reception radio frequency to the combining/distributing unit 4.

The filter (first calibration signal detecting unit) 6 is for permitting, of signals with transmission radio frequencies from the frequency fractionation unit 5, only a calibration signal component to pass to detect a calibration signal, and the frequency converter 7 is for converting the frequency of the calibration signal, which has passed through the filter 6, into a reception radio frequency in the radio receiver 21-*i*. Thus, the calibration signal after the conversion passes through the frequency fractionation unit the combining/distributing unit 4, the directional coupler 2-1 and the frequency fractionation unit 3-*i* and is feedbacked to the reception system and received by the radio receiver 21-*i*.

That is, the block composed of the directional couplers 2-*i*, the frequency fractionation units 3-*i*, the combining/distributing unit 4, the frequency fractionation unit 5, the filter 6 and the frequency converter 7 functions as calibration signal detection/frequency conversion means to detect a calibration signal from the output of the radio transmitter 15-*i* for converting it into a predetermined reception radio frequency and further to output the conversion result together with a reception main signal to the radio receivers 21-*i*.

Moreover, in the reception system, each of the radio receivers (reception means) 21-*i* has a function to receive a signal with a reception radio frequency inputted from the frequency fractionation unit 3-*i* for making a frequency conversion (down-conversion) into a baseband signal, and each of the reception data phase shifters 22-*i* has a function to adjust the phase of a signal (baseband signal) from the radio receiver 21-*i* in accordance with a correction signal (phase adjustment signal) from the correction signal producer 32, and the reception data processor 23 has a function to carry out necessary reception processing on the signal after the phase adjustment by each of the reception data phase shifters 22-*i* .

Still moreover, in the calibration control system, the calibration timing controller 31 is designed to control the timing of the production (output) of a calibration signal by each of the calibration signal producers 13-*i* and the production of the phase adjustment signal by the correction signal producer 32 (TX/RX relative phase difference detector 36), and the correction signal producer (relative phase difference detecting means) 32 is designed to detect a calibration signal from the output of each of the radio receivers 21-*i* for each branch antenna 1-*i* to obtain a relative phase difference between the calibration signals (between branch antennas 1-*i*).

Yet moreover, in this correction signal producer 32, each of the calibration signal detectors (second calibration signal detecting unit) 33-*i* is made to detect a calibration signal from an output signal (baseband signal) from each of the radio receivers 21-*i*, and each of the phase detectors 34-*i* is made to detect a reception phase (or angle) of the calibration signal detected by the corresponding calibration signal detector 33-*i*, and each of the phase memories 35-*i* is made to store information on the phase (or angle) detected by the corresponding phase detector 34-*i*. In this embodiment, since the calibration signal transmitted from the radio transmitter 15-*i* is feedbacked to the radio receiver 21-*i* and received thereby as mentioned above, the phase information to be stored here signifies information to be used in common (commonized) with respect to both the transmission system and reception system.

The TX/RX relative phase difference detector 36 is for detecting the relative phase differences between the branch antennas 1-*i* (between the radio transmitters 15-*i*, between the radio receivers 21-*i*) in the reception system and the transmission system (or one of the reception system and the transmission system) on the basis of the phase information stored in the respective phase memories 35-*i* and further for outputting the information on the relative phase difference as the aforesaid correction signal (phase adjustment signal) to the reception data phase shifter 22-*i* or the transmission data phase shifter 12-*i*.

That is, the transmission data phase shifters 12-*i* and the reception data phase shifters 22-*i* function as phase correction means to correct the phase differences on one of or both the transmission main signals to the branch antennas 1-*i* and the reception main signals from the branch antennas 1-*i* on the basis of the relative phase difference obtained in the correction signal producer 32 serving as the relative phase difference detecting means.

A description will be given hereinbelow of a calibration method in the array antenna communication system thus configured.

A calibration signal produced in the calibration signal producer 13-*i* is added to a transmission main signal (baseband signal) for the branch 1-*i* in the corresponding adder 14-*i* and inputted to the corresponding radio transmitter 15-*i* and up-converted into a transmission radio frequency by this radio transmitter 15-*i*.

The radio signal after the up-conversion is inputted through the frequency fractionation unit 3-*i* to the directional coupler 2-*i* where it is divided into two: one for the branch 1-*i* and the other for the combining/distributing unit 4. The transmission data for the branch 1-*i*, inputted to the combining/distributing unit 4, is outputted through the frequency fractionation unit 5 to the filter 6 where a calibration signal component is detected therefrom, with the detected calibration signal component being converted into a reception radio frequency in the frequency converter 7 and then feedbacked to the frequency fractionation unit 5.

The combining/distributing unit 4 distributes the feedbacked calibration signal component through the directional couplers 2-*i* and the frequency fractionation units 3-*i* to the radio receivers 21-*i*. This signifies that the calibration signals outputted from the calibration producers 13-*i* are receivable by all the radio receivers 21-*i* for the branches 1-*i*.

Each of the radio receivers 21-*i* makes a down-conversion of the received signal into a baseband signal. Each received baseband signal including a calibration signal is inputted to the correction signal producer 32. In the correction signal producer 32, each of the calibration signal detectors 33-*i* detects the calibration signal for each radio receiver 21-*i*, and each of the phase detectors 34-*i* detects each phase (or angle) , and each of the phase memories 35-*i* retains the phase information.

The information retained therein is phase information detected from the calibration signals outputted from the radio transmitters 15-*i* for the branches 1-*i* and received by all the radio receivers 21-*i* and, on the basis of this information, the TX/RX relative phase difference detector 36 detects the relative phase difference between the calibration signals and supplies it as a correction signal for received data to the reception data phase shifter 22-*i*.

The reception data phase shifter 22-*i* carries out a phase correction on a received baseband signal on the basis of the a fore said correction signal. In a case in which the switching of the calibration signal producer 13-*i*, which is to transmit a calibration signal, is made selectively (in a time division fashion) by the calibration timing controller 31, whenever the branch 1-*i* handling radio transmitter 15-*i*, which is to output a calibration signal, is switched, the calibration signal is detected by the correction signal producer 32 and the phase thereof is detected so that the phase information is retained in the phase memory 35-*i* according to branch 1-*i* handling radio transmitter 15-*i* which is made to output a calibration signal.

This signifies that the phase memory 35-*i* of the correction signal producer 32 for each branch 1-*i* retains the phase of the calibration signals of all the calibration signal out putting radio transmitters 15-*i*. Accordingly,through the use of the phase information on the calibration signals of the respective radio transmitters 15-*i* retained in the phase memories 35-*i*, the TX/RX relative phase difference detector 36 detects relative phase differences, and supplies them as correction signals for the transmission data to the transmission data phase shifters 12-*i*. The transmission data phase shifter 12-*i* carries out a phase correction on a transmission baseband signal on the basis of this correction signal.

As described above, in the foregoing array antenna communication system, all the branch antenna 1-*i* handling radio receivers 21-*i* can receive the calibration signals all the branch antenna 1-*i* handling radio receivers 15-*i* output, which enables the phase information to be detected in all the calibration signal paths. Therefore, unlike the prior art, it is possible to realize the array antenna calibrations for the transmission system and the reception system without separately requiring radio receivers dedicated to calibrations.

[B] Description of First Embodiment

Figure 2:
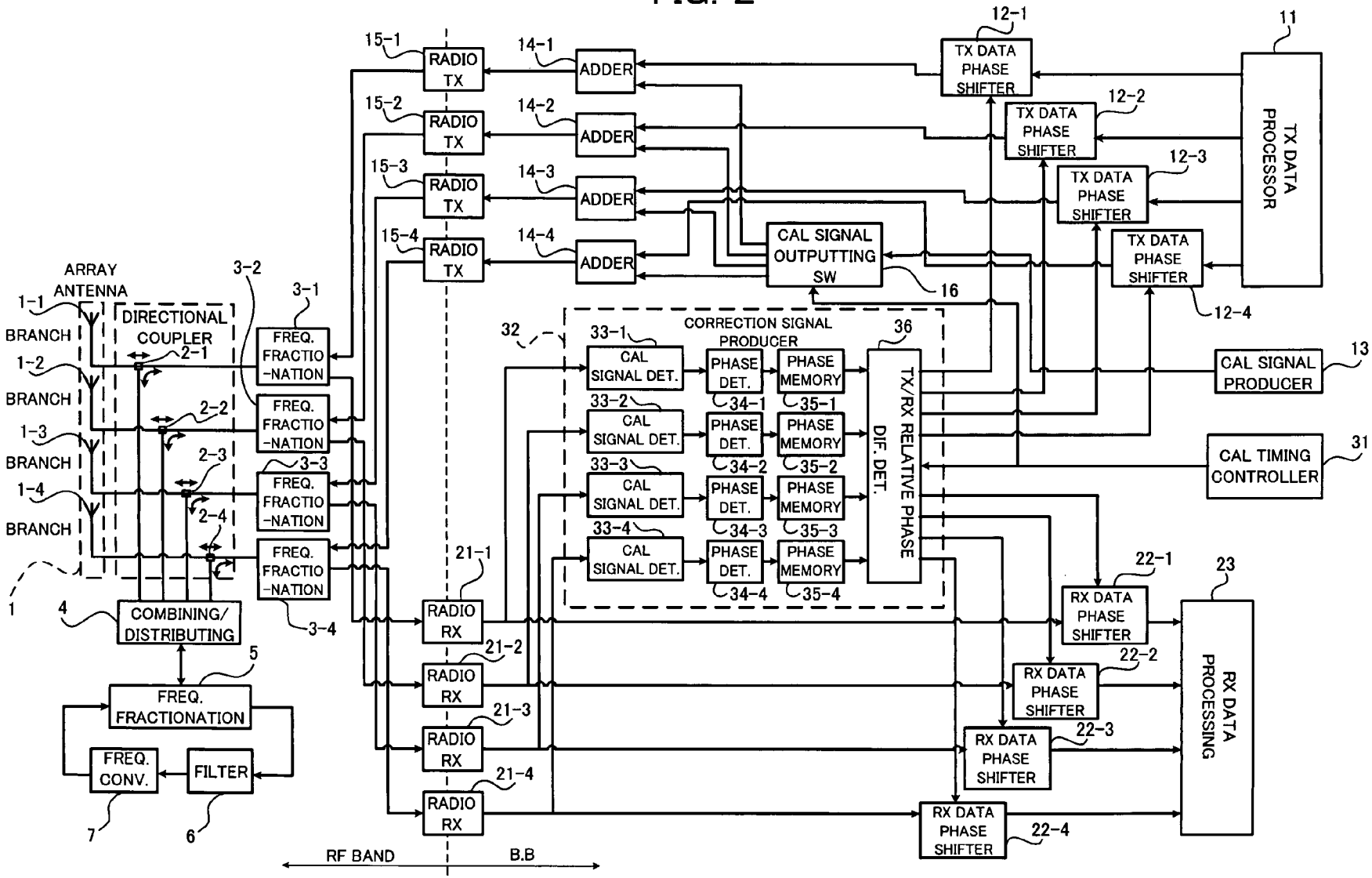
FIG. 2 is a block diagram showing a configuration of an array antenna communication system according to a first embodiment of the present invention.

FIG. 2 is a block diagram showing a configuration of an array antenna communication system according to a first embodiment of the present invention. The system shown in FIG. 2 differs from the system described above with reference to in FIG. 1 in that, in place of the aforesaid calibration signal producers 13-*i*, a single calibration signal producer (common calibration signal producing unit) 13 is provided in common (commonized) with respect to the respective branch antennas 1-*i* and a calibration signal outputted from this calibration signal producer 13 is selectively (in a time division fashion) inputted through a calibration signal outputting switch [calibration signal selective-outputting unit (hereinafter equally referred to simply as a "switch")] 16 to the adders 14-*i*. Moreover, the control of the selective (time division) output (switch 16) of the calibration signal is executed in the calibration timing controller 31. In FIG. 2, unless otherwise specified particularly, the same reference numerals as those used above designate the same or corresponding parts.

In the array antenna communication system thus configured according to this embodiment, a calibration signal common to the respective branch 1-*i* handling radio transmitters 15-*i* is produced in the calibration signal producer 13. The radio transmitter 15-*i* to which the calibration signal is to be outputted is selected by the calibration signal outputting switch 16 under control of the calibration timing controller 31, and this calibration signal is inputted to the selected radio transmitter 15-*i*.

At this time, the calibration timing controller 31 controls the output timing of the calibration signal so that the calibration signals outputted from the branch 1-*i* handling radio transmitters 15-*i* form a time-division multiplexed frame in the combining/distributing unit 4.

The calibration signals inputted from the radio transmitters 15-*i* through the frequency fractionation units 3-*i* and the directional couplers 2-*i* to the combining/distributing unit 4 and time-division-multiplexed therein are inputted through the frequency fractionation unit 5 to the filter 6 and, after the filtering by the filter 6, converted into reception radio frequency by means of the frequency converter 7 and distributed through the frequency fractionation unit 5, the combining/distributing unit 4, the directional couplers 2-*i* and the frequency fractionation units 3-*i* to the antenna 1-*i* handling radio receivers 21-*i*.

Following this, as in the case of the system described above with reference to FIG. 1, a relative phase difference between the calibration signals is detected in the correction signal producer 32 to produce correction signals for the transmission data and the reception data, and the correction signals are supplied to the transmission data phase shifters 12-*i* and the reception data phase shifters 22-*i*, thus carrying out the phase corrections.

As described above, with the system according to this embodiment, since the calibration signal producer 13 is provided in common with respect to the respective branches 1-*i*, in comparison with the configuration shown in FIG. 1, the scale thereof is reducible to ¼. In addition, since the calibration signal is used in common with respect to the calibrations in the transmission and reception systems, the scale of the calibration signal producing section is reducible to ½ (finally, ⅛ in comparison with a case in which the calibration producer is provided for each branch 1-*i* and for each transmission/reception system).

[C] Description of Second Embodiment

Figure 3:
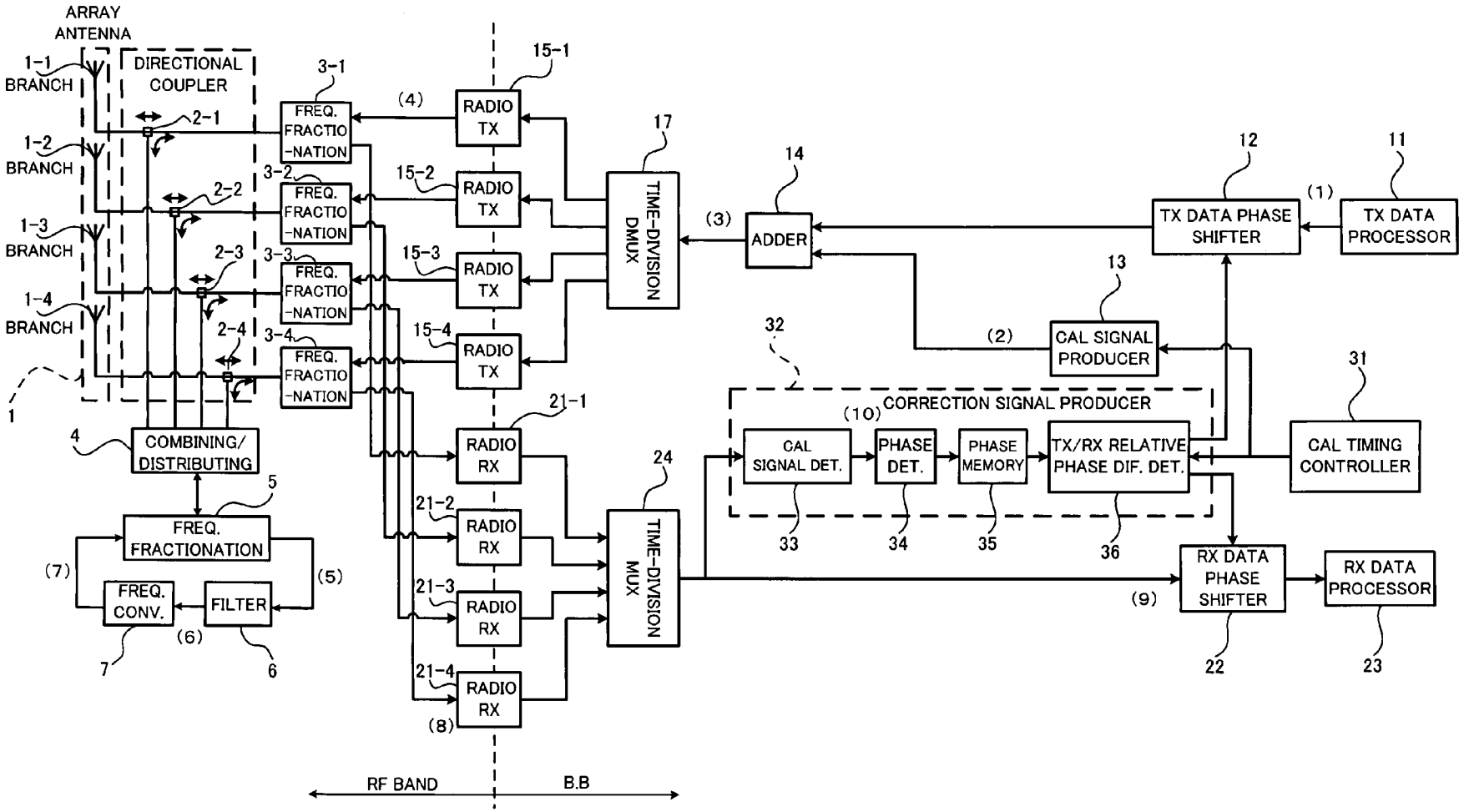
FIG. 3 is a block diagram showing an array antenna communication system according to a second embodiment of the present invention.

FIG. 3 is a block diagram showing a configuration of an array antenna communication system according to a second embodiment of the present invention. The system shown in FIG. 3 relates to a configuration for time-division-multiplexing transmission/reception system main signals, and differs from the system configuration described above with reference to FIG. 1 in that a time-division demultiplexer 17 is provided in the transmission system so that, in place of the transmission data phase shifter 12-*i*, the calibration signal producer 13-*i* and the adder 14-1 for each branch antenna 1-*i* (for each radio transmitter 15-*i*), each of a transmission(TX) data phase shifter 12, a calibration signal producer 13 and an adder 14 is provided in common (commonized) with respect to the branch antennas 1-*i* while a time-division multiplexer 24 is provided in the reception system so that, in place of the reception (RX) data phase shifter 22-*i* for each branch antenna 1-*i* (for each radio receiver 21-*i*) , a reception data phase shifter 22 is provided in common with respect to the branch antennas 1-*i* and, in this connection, instead of the calibration signal detectors 33-*i*, the phase directors 34-*i* and the phase storage memories 35-*i*, each of a calibration signal detector 33, a phase detector 34 and a phase memory 35 is used in common in the correction signal producer 32.

In this case, in the transmission system, the transmission data processor 11 outputs transmission baseband main signals to the branch antennas 1-*i* in the form of a time-division multiplexed frame, and the transmission data phase shifter 12, the calibration signal producer 13 and the adder 14 them selves respectively have the same functions as those of the above-mentioned transmission data phase shifter 12-*i*, calibration signal producer 13-*i* and adder 14-*i*. In this embodiment, in connection with the transmission baseband main signals being made in the form of a time-division multiplexed frame, they are designed to operate in a time division fashion. That is, in this embodiment, the calibration signal producer 13 functions as a time-division calibration signal producing unit to produce a calibration signal in a time division fashion under the time division timing control of the calibration timing controller 31.

The time-division demultiplexer 17 is for demultiplexing an output (transmission base band signal) of the aforesaid adder 14 in a time division fashion to distribute them to the radio transmitters 15-*i*.

In addition, in the reception system, the time-division multiplexer 24 is for multiplexing the outputs (reception baseband signals) of the respective radio receivers 21-*i* in a time division fashion to output a time-division multiplexed frame, and the reception data phase shifter 22 fulfills the same function as that of the above-mentioned reception data phase shifter 22-*i* and operates in a time division fashion because the reception baseband signals being time-division-multiplexed. In this connection, the reception data processor 23 also operates in a time division fashion.

Still additionally, in the correction signal producer 32, the calibration signal detector 33, the phase detector 34 and the phase memory 35 themselves have the same functions as those of the aforesaid calibration signal detector 33-*i*, the phase detector 34-*i* and the phase memory 35-*i*, respectively. On the other hand, in this embodiment, since the baseband signals for the branch antennas 1-*i* are converted into a time-division multiplexed frame, the correction signal producer 32 also operates in a time division fashion, and the correction signals for the TX/RX calibrations are outputted in a time division fashion.

That is, in this embodiment, the calibration signal detector 33 functions as a time-division calibration signal detecting unit to detect a calibration signal for each branch antenna 1-*i* from an output (time-division multiplexed frame) of the time-division multiplexer 24, and the phase detector 34 functions as a time-division phase detecting unit to detect the phase of each calibration signal detected by the calibration signal detector 33 in a time division fashion, and the TX/RX relative phase difference detector 36 functions as a time-division relative phase difference to detect a relative phase difference between the calibration signals on the basis of a result of each detection in the phase detector 34 in a time division fashion.

Figure 4:
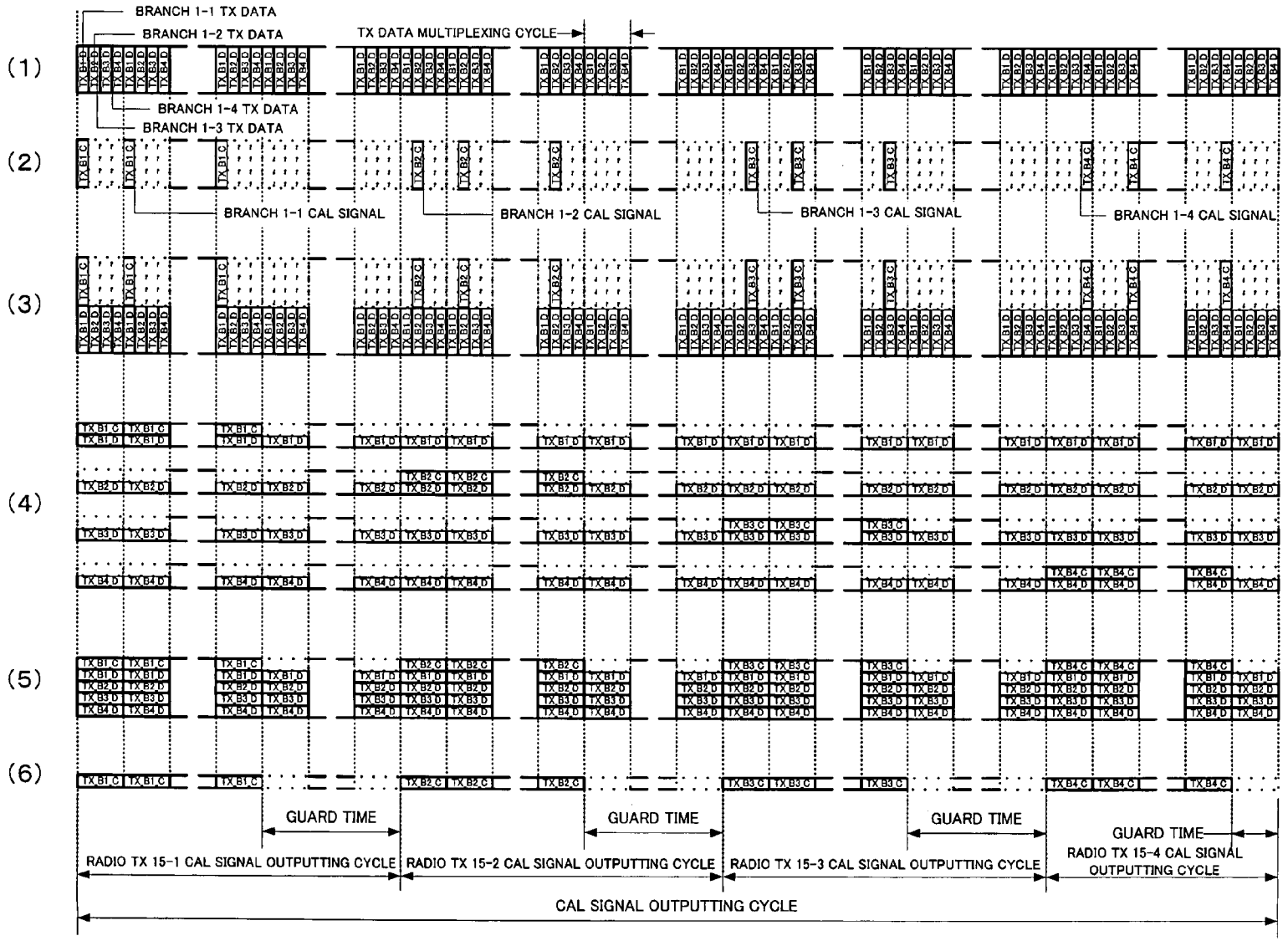
FIG. 4 is a time chart showing operation timings in a transmission system for explaining a calibration operation in the array antenna communication system shown in FIG. 3.
Figure 5:
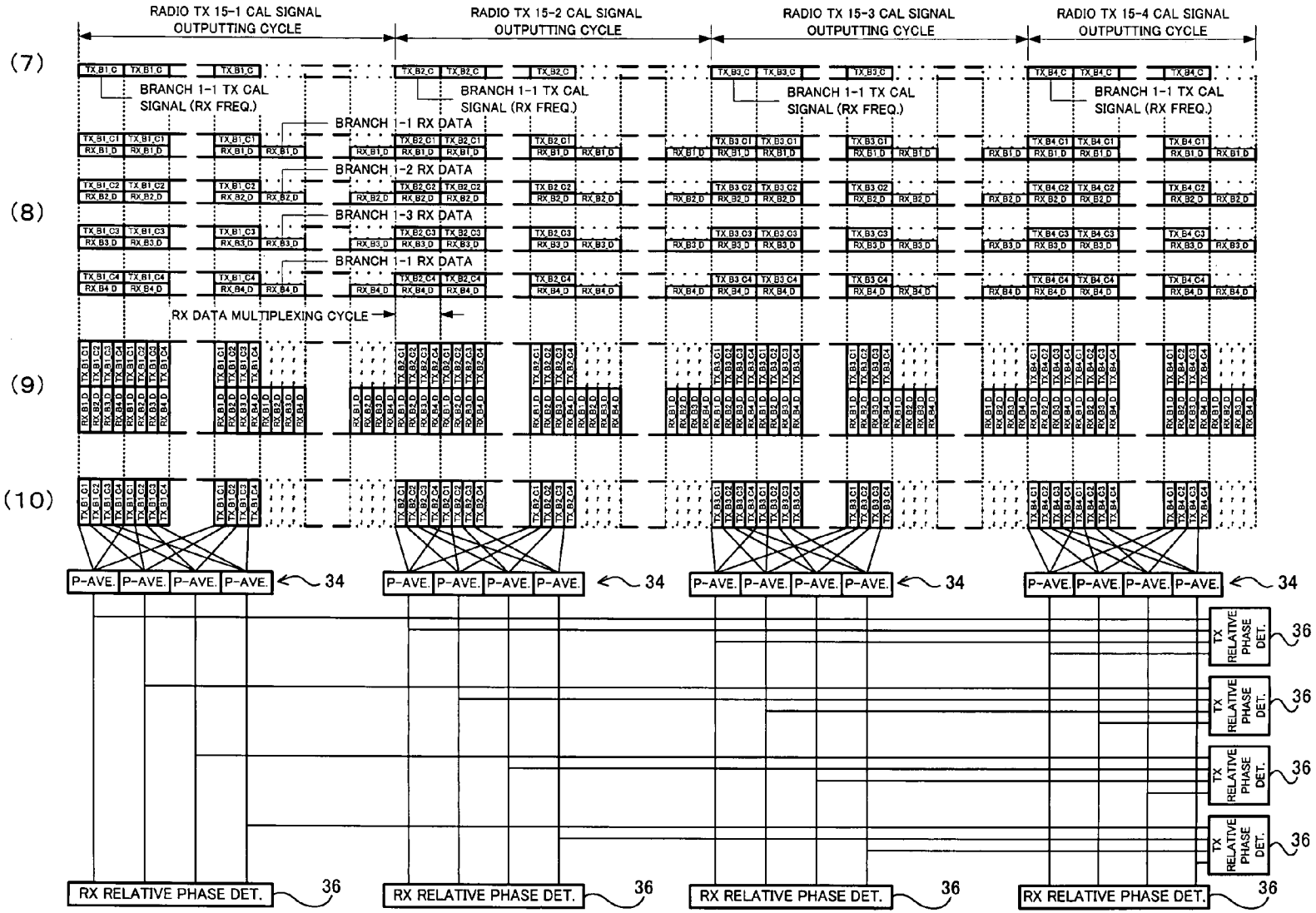
FIG. 5 is a time chart showing operation timings in a reception system for explaining a calibration operation in the array antenna communication system shown in FIG. 3.

A description will be given hereinbelow of a calibration method in the system thus configured according to this embodiment. FIG. 4 is a time chart showing operation times in the transmission system, and FIG. 5 is a time chart showing operation times in the reception system where (1) to (6) in FIG. 3, correspond to (1) to (6) in FIG. 4, respectively, and (7) to (10) in FIG. 3 correspond to (7) to (10) in FIG. 5, respectively. In FIGS. 3 and 4, the branch antennas 1-1, 1-2, 1-3 and 1-4 are expressed as branches 1-1, 1-2, 1-3 and 1-4, respectively, and the transmission main signals directed at the branch antennas 1-1, 1-2, 1-3 and 1-4 are expressed as "TX_B1_D", "TX_B2_D", "TX_B3_D" and "TX_B4_D", respectively. Moreover, the calibration signals for the branch antennas 1-1, 1-2, 1-3 and 1-4 are expressed as "TX_B1_C", "TX_B2_C", "TX_B3_C" and "TX_B4_C", respectively, and the reception main signals for the branch antennas 1-1, 1-2, 1-3 and 1-4 are expressed as "RX_B1_D", "RX_B2_D", "RX_B3_D" and "RX_B4_D", respectively.

First of all, the transmission data processor 11 outputs transmission baseband main signals directed at the branch antennas 1-*i* (radio transmitters 15-*i*) in the form of a time-division multiplexed frame (see (1) in FIG. 4). The calibration signal producer 13 outputs the calibration signal to the adder 14 in accordance with the timing of the related branch antenna 1-*i* in this time-division multiplexed frame under control of the calibration timing controller 31 [see (2) in FIG. 4]. Accordingly, the calibration signal is added to the transmission baseband main signal at the timing of the related branch antenna 1-*i* in the time-division multiplexed frame [see (3) in FIG. 4].

The time-division multiplexed frame signal in which the addition of the calibration signal takes place is separated into data according to radio transmitter 15-*i* by the time-division demultiplexer 17 [see (4) in FIG. 4] and outputted to the respective radio transmitters 15-*i*.

The output of each of the radio transmitters 15-*i* is transmitted from each of the branch antennas 1-*i* of the array antenna 1 through the frequency fractionation unit 3-*i* and the directional coupler 2-*i* and inputted to the combining/distributing unit 4. The signal inputted to the combining/distributing unit 4 is outputted through the frequency fractionation unit 5 to the filter 6 [see (5) in FIG. 4] so that a calibration signal component is detected through the filter 6 and inputted to the frequency converter 7 in a time division fashion [see (6) in FIG. 4]. In this case, guard times are set with respect to the cycle of calibration signal output from each of the radio transmitters 15-*i* so as to prevent different calibration (CAL) signals for the branch antennas 1-*i* from colliding with each other.

The frequency converter 7 successively converts the calibration signal inputted in the time division fashion into a reception radio frequency [see (7) in FIG. 5], and the calibration signal after the frequency conversion is feedbacked, together with a reception main signal from the branch antenna 1-*i*, through the frequency fractionation unit 5, the directional couplers 2-*i* and the frequency fractionation units 3-*i* to the radio receivers 21-*i* [see (8) in FIG. 5] and down-converted into a baseband signal therein and inputted to the time-division multiplexer 24.

The time-division multiplexer 24 multiplexes the inputted signals from the radio receivers 21-*i* in a time division fashion to output them as a time-division multiplexed frame [see (9) in FIG. 5]. This time-division multiplexed frame is inputted to the reception data phase shifter 22 and further to the correction signal producer 32. In the correction signal producer 32, the calibration signal detector 33 detects a calibration signal component from the time-division multiplexed frame, and the phase detector 34 detects a phase of the detected calibration signal for each of the branch antennas 1-*i*. At this time, it is also appropriate that the calibration signal phases of a plurality of frames (three frames in FIG. 5) related to the same branch antenna 1-*i* are averaged to obtain an average value [see (10) in FIG. 5].

Moreover, the phase memory 35 once stores the detected phase information, and the TX/RX relative phase difference detector 36 detects relative phase differences between the branch antennas 1-*i* in the transmission system and in the reception system, with each of the detected relative phase differences being inputted as a correction signal to the transmission data phase shifter 12 and further to the reception data phase sifter 22, thereby carrying out the calibrations.

As described above, according to this embodiment, since the calibration processing can be conducted in a time division fashion, the circuit scale of each of the transmission system, the reception system and the calibration control system is considerably reducible.

[D] Description of Third Embodiment

Figure 6:
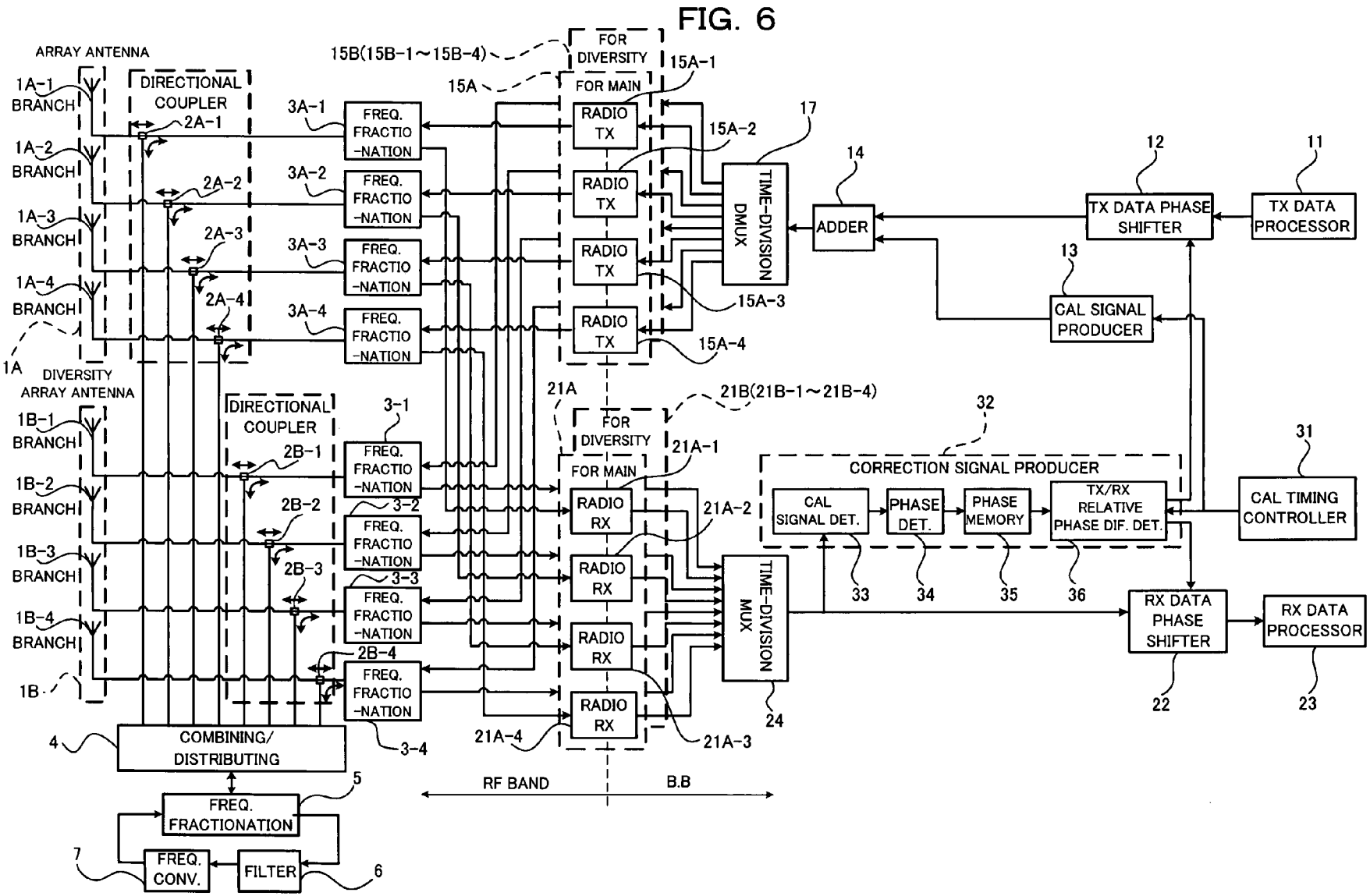
FIG. 6 is a block diagram showing a configuration (transmission and reception diversity arrangement) of an array antenna communication system according to a third embodiment of the present invention.

FIG. 6 is a block diagram showing a configuration of an array antenna communication system according to a third embodiment of the present invention. The system shown in FIG. 6 is based upon the time-division multiplexing configuration described above with reference to FIG. 3 and is designed such that the array antenna has a transmission and reception diversity arrangement, and its transmission and reception shared section includes an main array antenna 1A having a plurality of (for example, N=4) sensor elements (branch antennas) 1A-1 to 1A-N, directional couplers 2A-1 to 2A-N each provided for each of the branch antennas 1A-*i*

(i=1 to N), frequency fractionation units 3A-1 to 3A-N provided for each of the branch antennas 1A-*i*, a diversity antenna 1D having a plurality of (for example, N=4) sensor elements (branch antennas) 1B-1 to 1B-N, directional couplers 2B-1 to 2B-N each provided for each of the branch antennas 1B-*i* (i=1 to N), frequency fractionation units 3B-1 to 3B-N provided for each of the branch antennas 1A-*i*, a combining/distributing unit 4, a frequency fractionation unit 5, a filter 6 and a frequency converter 7.

In addition, the transmission system includes a transmission data processor 11, a transmission (TX) data phase shifter 12, a calibration signal producer 13, an adder 14, a time-division demultiplexer 17, a main radio transmission unit 15A having radio transmitters 15A-1 to 15A-N for the main array antenna 1A (branches 1A-*i*), and a diversity radio transmission unit 15B having radio transmitters 15B-1 to 15B-N for the diversity array antenna 1B (branches 1B-*i*).

Still additionally, the reception system includes a main radio reception unit 21A having radio receivers 21A-1 to 21A-N for the main array antenna 1A (branches 1A-*i*), a diversity radio reception unit 21B having radio receivers 21B-1 to 21B-N for the diversity array antenna 1B (branches 1B-*i*), a time-division multiplexer 24, a reception data phase shifter 22 and a reception(RX) data processor 23.

In this configuration in the transmission system, the transmission data processor 11 is for conducting necessary transmission processing on data (main signal) to be transmitted and, as well as the second embodiment, it is made to output transmission baseband main signals to the branches 1A-*i* of the main array antenna 1A and to the branches 1B-*i* of the diversity array antenna 1B in the form of a time-division multiplexed frame.

Each of the transmission data phase shifter 12, the calibration signal producer 13 and the adder 14 is the same as that mentioned above with respect to FIG. 3 in the second embodiment and is made to operate in a time division fashion in connection with the transmission baseband main signals being formed as a time-division-multiplexed frame.

The time-division demultiplexer 17 is for demultiplexing an output signal from the adder 14 to distribute them to the radio transmitters 15A-*i* of the main radio transmission unit 15A and to the radio transmitters 15B-*i* of the diversity radio transmission unit 15B, and the radio transmitters 15A-*i* and 15B-*i* are the same as the above-mentioned radio transmitters 15-*i* and have a necessary transmission processing function, such as up-converting a transmission baseband main signal, to which a calibration signal from the time-division demultiplexer 17 is added (superimposed) , into a transmission radio frequency.

Moreover, in the transmission/reception shared section, each of the main array antenna 1A side frequency fractionation units 3A-*i* fractionates the frequency of an input signal to output a signal with a transmission radio frequency from the radio transmitter 15A-*i* of the main radio transmission unit 15A to the main array antenna 1A side, and outputs a signal with a reception radio frequency from the main array antenna 1A side to the radio receiver 21A-*i* of the main radio reception unit 21A, while each of the diversity array antenna 1B side frequency fractionation units 3B-*i* sorts out the frequency of an input signal to output a signal with a transmission radio frequency from the radio transmitter 15B-*i* of the diversity radio transmission unit 15B to the diversity array antenna 1B side, and outputs a signal with a reception radio frequency from the diversity array antenna 1B side to the radio receiver 21B-*i* of the diversity radio reception unit 21B.

Still moreover, each of the main array antenna 1A side directional couplers 2A-*i* outputs a transmission signal from the frequency fractionation unit 3A-*i* to the branch 1A-*i* of the main array antenna 1A and further to the combining/distributing unit 4, and outputs a signal from the combining/distributing unit 4 to the frequency fractionation unit 3A-*i* side. Yet moreover, each of the diversity array antenna 1B side directional couplers 2B-*i* outputs a transmission signal from the frequency fractionation unit 3B-*i* to the branch 1B-*i* of the diversity array antenna 1B and further to the combining/distributing unit 4, and outputs a signal from the combining/distributing unit 4 to the frequency fractionation unit 3B-*i* side.

The combining/distributing unit 4 combines signals inputted in a state branched by the directional couplers 2A-*i* and 2B-*i* and distributes a signal from the frequency fractionation unit 5 to the directional couplers 2A-1 and 2B-*i*, and the frequency fractionation unit 5 fractionates a frequency of an inputted signal and outputs a signal with a transmission radio frequency to the filter 6, and outputs a signal with a reception radio frequency to the combining/distributing unit 4.

The filter 6 is made to permit, of the signal with the transmission radio frequency from the frequency fractionation unit 5, only the calibration signal component to pass, thereby detecting the calibration signal. The frequency converter 7 converts the frequency of the calibration signal, which has passed through the filter 6, into a reception radio frequency. Therefore, after passing through the frequency fractionation unit 5, the combining/distributing unit 4, the directional couplers 2A-*i*, 2B-*i* and the frequency fractionation units 3A-*i*, 3B-*i*, the calibration signal after the conversion is received by the radio receivers 21A-*i* and 21B-*i*.

Furthermore, in the reception system, each of the radio receivers 21A-*i* of the main radio reception unit 21A has a function to down-convert a signal with a reception radio frequency, inputted from the main array antenna 1A side frequency fractionation unit 3A-*i*, into a baseband signal, and each of the radio receivers 21B-*i* of the diversity radio reception unit 21B has a function to down-convert a signal with a reception radio frequency, inputted from the diversity antenna 1B side frequency fractionation unit 3B-*i*, into a baseband signal.

The time-division multiplexer 24 is made to time-division-multiplex the outputs (reception baseband signals) of the respective radio receivers 21-*i* for outputting a time-division multiplexed frame, and the reception data phase shifter 22 is made to operate in a time division fashion in accordance with a correction signal inputted from the correction signal producer 32 in a time division fashion to correct the phase of the time-division multiplexed frame forming reception data, and the reception data processor 23 is made to carry out necessary reception processing on the time-division multiplexed frame after the phase correction.

Still furthermore, in the calibration control system, the calibration timing controller 31 and the correction signal producer 32 (the calibration signal detector 33, the phase detector 34, the phase memory 35 and the TX/RX relative phase difference detector 36) are the same as those described above with reference to FIG. 3, respectively, and in this embodiment, the time-division operation is conducted in accordance with the timing control by the calibration timing controller 31, and the calibration signal phases thus the relative phase differences for the transmission system, the reception system, the main array antenna 1A and the diversity array antenna 1B are detected on the basis of the time-division multiplexed frame from the time-division multiplexer 24 to be outputted as correction signals to the transmission data phase shifter 12 and the reception data phase shifter 22.

With the system thus configured according to this embodiment, the calibration signals outputted from all the branch 1A-*i* and 1B-*i* handling radio transmitters 15A-*i* and 15B-*i* are receivable by all the branch 1A-*i* and 1B-*i* handling radio receivers 21A-*i* and 21B-*i* through the frequency fractionation units 3A-*i*, 3B-*i*, the directional couplers 2A-*i*, 2B-*i*, the combining/distributing unit 4, the frequency fractionation unit 5, the filter 6 and the frequency converter 7.

Moreover, the signals received by the radio receivers 21A-*i* and 21B-*i* are converted into baseband signals and then converted into a time-division multiplexed frame in the time-division multiplexer 24 and inputted to the reception data phase shifter 22 and the correction signal producer 32. As mentioned above with reference to FIG. 3, the correction signal producer 32 is operated in a time division fashion so as to detect the calibration signal phases thus the relation phase differences for the transmission system, the reception system, the main array antenna 1A and the diversity array antenna 1B on the basis of the time-division multiplexed frame for outputting as correction signals to the transmission data phase shifter 12 and the reception data phase shifter 22.

As described above, according to this embodiment, also in the system employing not only the main array antenna 1A but also the transmission and reception diversity arrangement including the diversity array antenna 1B, through the use of the same processing as the time division processing mentioned above with reference to FIG. 3, it is possible to realize the calibration processing, as in the case of no employment of the diversity array antenna 1B. Therefore, even in the case of the employment of the transmission and reception diversity arrangement, it is possible to carry out the calibrations flexibly for one of or both the main array antenna 1A and the diversity array antenna 1B with a minimum circuit scale. That is, this means that necessary calibrations are realizable irrespective of antenna arrangement or the number of branch antennas.

Figure 7:
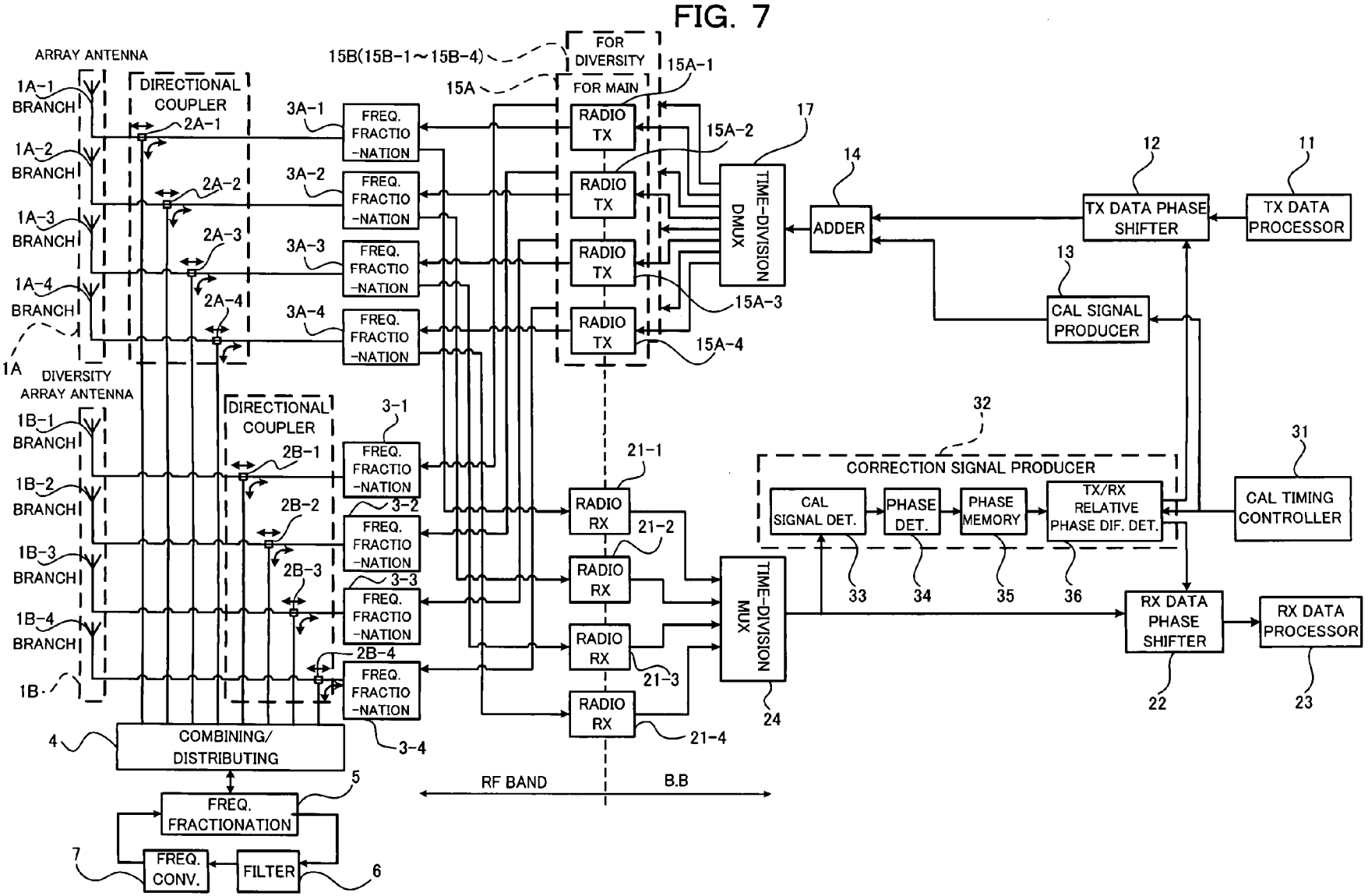
FIG. 7 is a block diagram showing a modification (transmission diversity arrangement) of the array antenna communication system shown in FIG. 6.
Figure 8:
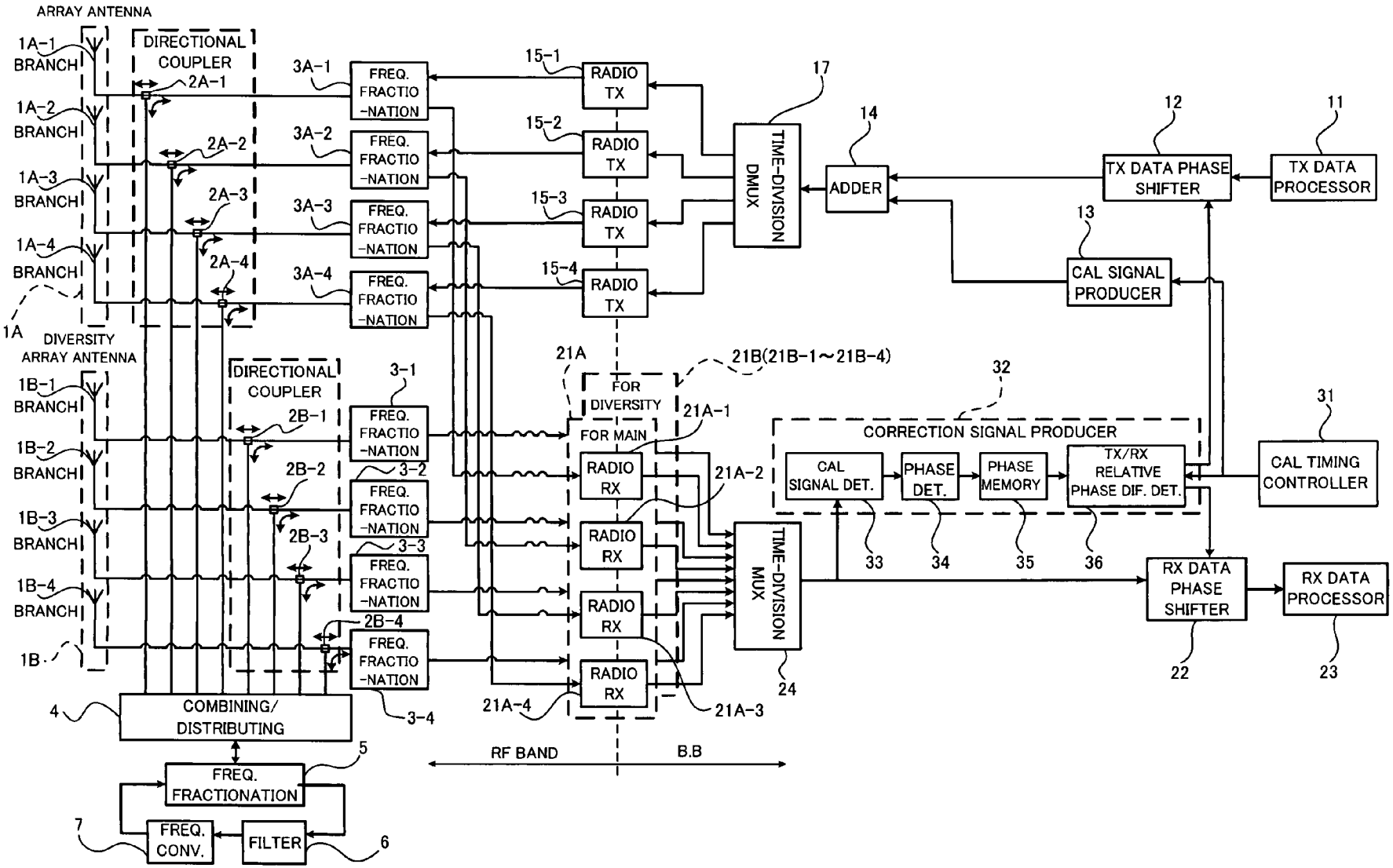
FIG. 8 is a block diagram showing a modification (reception diversity arrangement) of the array antenna communication system shown in FIG. 6.

Accordingly, even in the case of the employment of a transmission diversity arrangement including main and diversity radio transmission units 15A and 15B (radio transmitters 15A-*i* and 15B-*i*) for only the transmission system as shown in FIG. 7 or a reception diversity arrangement including main and diversity radio reception units 21A and 21B (radio receivers 21A-*i* and 21B-*i*) for only the reception system as shown in FIG. 8, it is possible to easily realize flexible calibrations without depending on the antenna arrangement and the number of branch antennas. In FIGS. 7 and 8, the same reference numerals as those used above designate the same or corresponding parts.

[E] Others

It should be understood that the present invention is not limited to the above-described embodiments, and that it is intended to cover all changes and modifications of the embodiments of the invention herein which do not constitute departures from the spirit and scope of the invention.

For example, each of the array antenna communication systems described above with reference to FIGS. 2 to 8 does not depend upon communication modes and, hence, it is applicable to, for example, various types of communication modes (multiple access modes) such as FDMA (Frequency Division Multiple Access) TDMA (Time Division Multiple Access) and CDMA (Code Division Multiple Access) . In addition, it is also applicable to multicarrier transmission (communication) modes such as OFDM (Orthogonal Frequency Division Multiplexing).

Furthermore, by changing configurations of the filter 6 for the calibration signal detection and the calibration signal detector 33 of the correction signal producer 32, it is possible to change the calibration signal, inserted into (added to) a main signal, to a fixed value, a sine wave, a spread spectrum signal and others.

Figure 9:
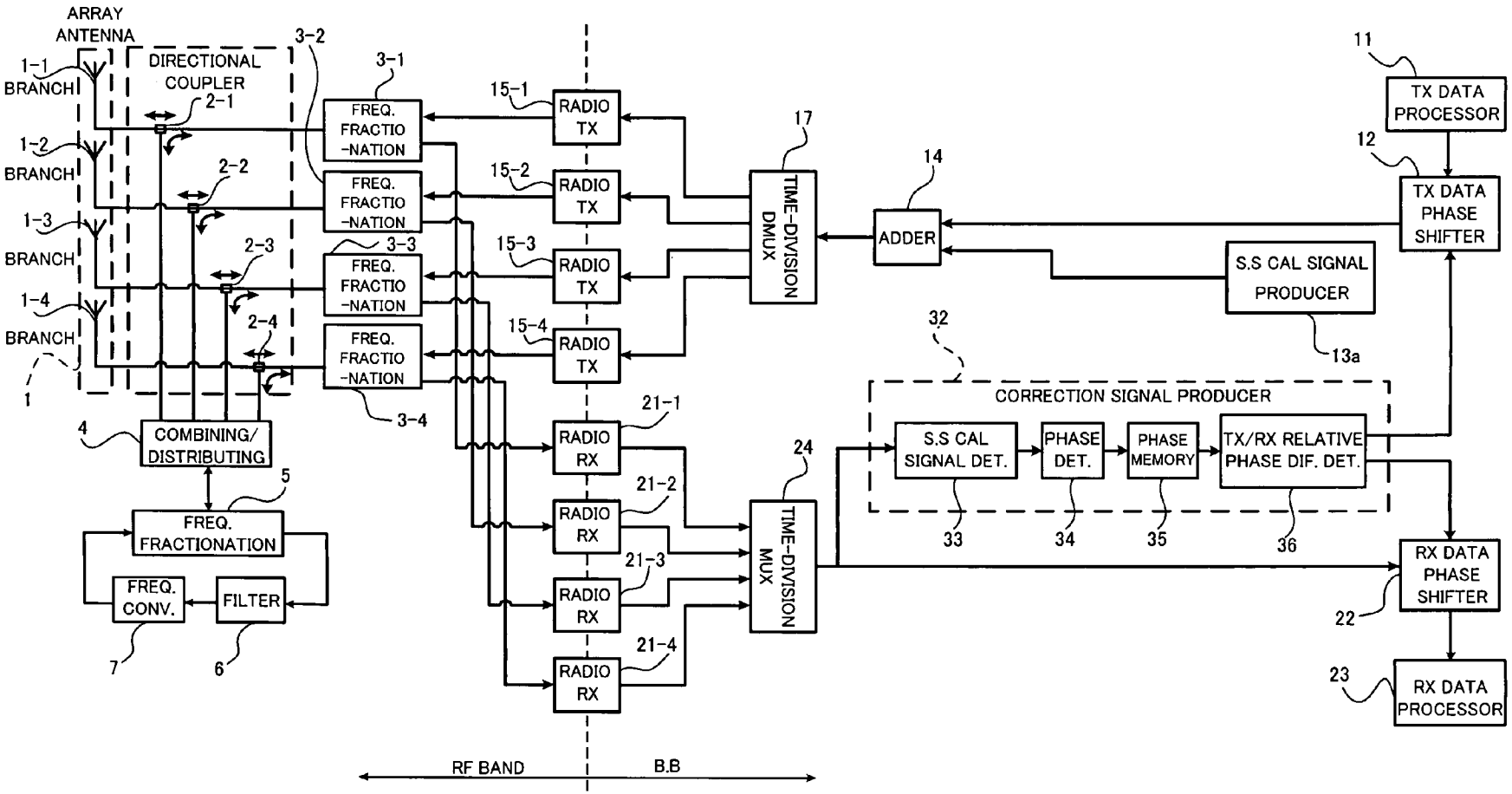
FIG. 9 is a block diagram showing a configuration to be taken for the employment of a CDMA signal as a calibration signal in the system configuration shown in FIG. 3.
Figure 10:
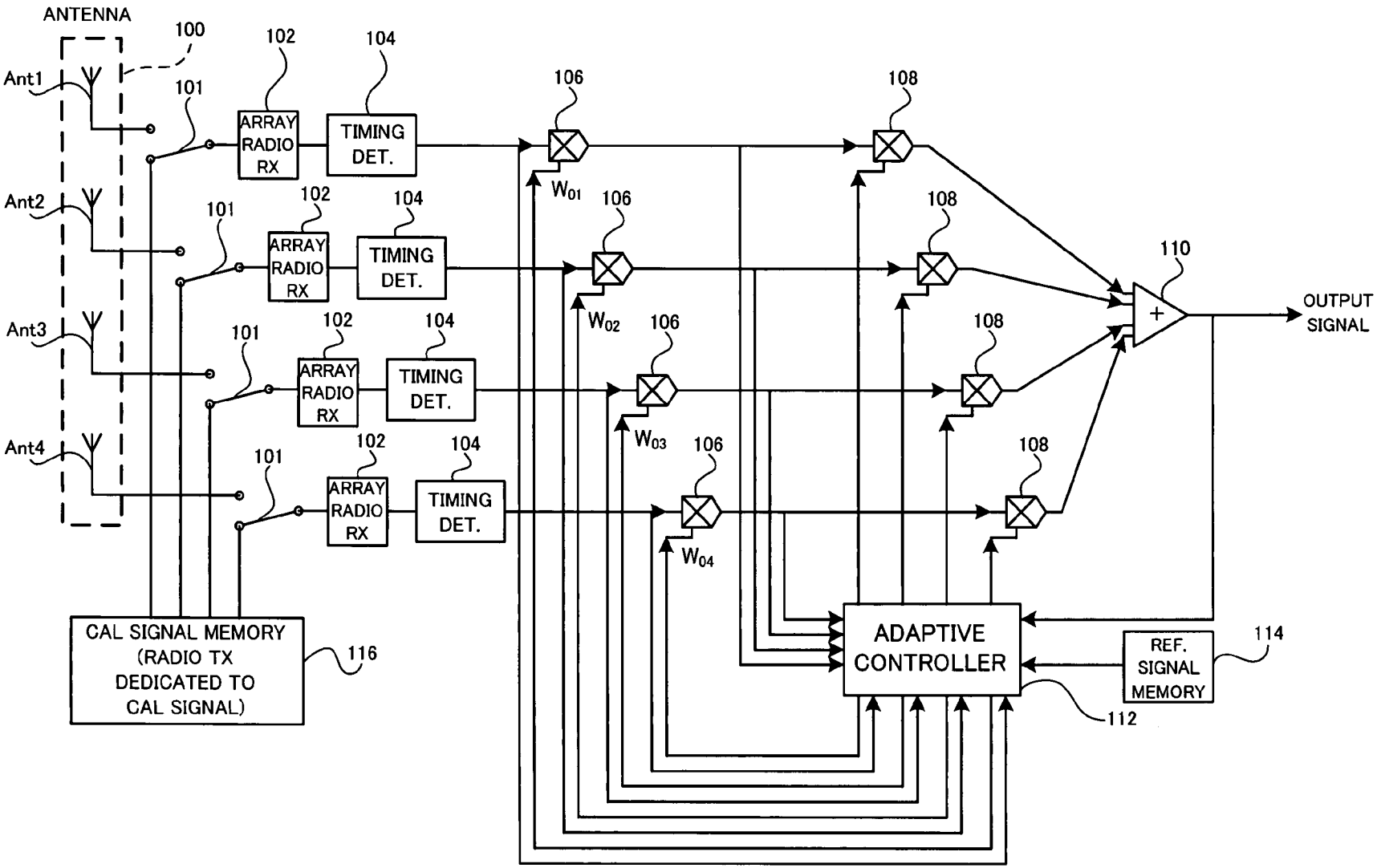
FIG. 10 PRIOR ART
FIG. 10 is an illustration for explaining a conventional calibration method for use in a reception system of an array antenna.

For example, FIG. 9 shows a configuration based upon the system configuration described above with reference to FIG. 3, where a CDMA signal is employed as a calibration signal. That is, in comparison with the configuration shown in FIG. 3, in the array antenna communication system shown in FIG. 9, a spread spectrum(S.S) calibration signal producer 13*a* is provided in place of the calibration signal producer 13 and, in the correction signal producer 32, a spread spectrum calibration signal detector 33*a* is provided instead of the calibration signal detector 33 while the calibration timing controller 31 becomes unnecessary. In FIG. 9, unless otherwise specified particularly, the same reference numerals as those used above designate the same or corresponding parts.

In this case, the spread spectrum calibration signal producer 13*a* is made to produce, as a calibration signal, a CDMA signal having a different spread code for each of the branch antenna 1-*i* handling radio transmitters 15-*i* for outputting it to the adder 14. The spread spectrum calibration signal detector 33*a* is made to detect the calibration signal with the aforesaid spread code from a time-division multiplexed frame outputted from the time-division multiplexer 24.

Accordingly, in this case, the phase detector 34 detects a phase for each of the calibration signals different in spread code, and the phase memory 35 stores this phase, and the TX/RX relative phase difference detecting unit 36 uses, as a correction signal for the reception system, a relative phase difference between the calibration signals with the same spread code received by the respective radio receivers 21-*i* for carrying out the calibrations for the reception system and uses, as a correction signal for the transmission system, a relative phase difference between the calibration signals with different spread codes for carrying out the calibrations for the transmission system.

In the system configured as described above, since the calibration signal for each of the branches 1-*i* is be identified by the spread code, the calibration signal can be placed into an outputting condition at all times and, in the reception system, it is possible to detect the spread code of the calibration signal outputted from each branch antenna 1-*i* handling radio transmitter 15-*i* so that the reception-system calibration is conducted through the use of a relative phase difference between the calibration signals with the same spread code received by each radio receiver 21-*i* and the transmission-system calibration is made through the use of a relative phase difference between the calibration signals with different spread codes. Therefore, this can eliminate the need for the employment of complicated calibration timing control, required for the aforesaid time division mode, thus eliminating the need for the employment of the aforesaid calibration timing controller 31.

What is claimed is:

1. A calibration apparatus for an array antenna having a plurality of antenna elements, comprising:

calibration signal producing means for producing a calibration signal for each of said antenna elements;

transmission means for outputting, to said antenna element, said calibration signal produced by said calibration signal producing means together with a transmission main signal at a predetermined transmission radio frequency;

reception means for receiving a reception main signal with a predetermined reception radio frequency from said antenna element;

calibration signal detection/frequency conversion means for detecting said calibration signal from the output of said transmission means to convert the detected calibration signal into a predetermined reception radio frequency and for outputting the converted calibration signal together with said reception main signal to said reception means;

relative phase difference detecting means for detecting said calibration signal from an output of said reception means for each of said antenna elements to obtain a relative phase difference between said calibration signals; and phase correcting means for correcting a phase difference with respect to one of or both said transmission main signal and said reception main signal on the basis of said relative phase difference obtained by said relative phase difference detecting means.

2. The calibration apparatus for an array antenna according to claim 1, wherein said calibration signal producing means includes calibration signal producing units each provided for each of said antenna elements for producing said calibration signal for each of said antenna elements, said transmission means includes:

adders each provided for each of said antenna elements for adding said calibration signal produced in each of said calibration signal producing units to said transmission main signal for each of said antenna elements; and radio transmitters each provided for each of said antenna elements for frequency-converting an output of each of said adders into said transmission radio frequency for outputting as a transmission signal to said antenna element, and said calibration signal detection/frequency conversion means includes:

a branch unit for taking out a portion of said transmission signal directed at said antenna element;

a first calibration signal detecting unit for detecting said calibration signal from said transmission signal taken out by said branch unit;

a frequency converter for converting said calibration signal detected by said first calibration signal detecting unit into said reception radio frequency; and a coupling unit for coupling said calibration signal frequency-converted by said frequency converter with said reception main signal from said antenna element to said reception means.

3. The calibration apparatus for an array antenna according to claim 1, wherein said calibration signal producing means includes a common calibration signal producing unit for producing said calibration signal in common with respect to said antenna elements, and said transmission means includes:

adders each provided for each of said antenna elements for adding said calibration signal to said transmission main signal for each of said antenna elements;

a calibration signal selective-outputting unit for selectively outputting said calibration signal produced in said common calibration signal producing unit to one of said adders; and radio transmitters each provided for each of said antenna elements for frequency-converting an output of each of said adders into said transmission radio frequency for outputting as a transmission signal to said antenna element.

4. The calibration apparatus for an array antenna according to claim 1, wherein said relative phase difference detecting means includes:

second calibration signal detecting units each provided for each of said antenna elements for detecting said calibration signal from an output of said reception means for each of said antenna elements;

phase detecting units each provided for each of said antenna elements for detecting a phase of each of said calibration signals detected by said second calibration signal detecting units; and a relative phase difference detecting unit for detecting said relative phase difference between said calibration signals on the basis of a result of the detection in each of said phase detecting units.

5. The calibration apparatus for an array antenna according to claim 1, wherein said calibration signal producing means includes a time-division calibration signal producing unit for producing said calibration signal for each of said antenna elements in a time division fashion, and said transmission means includes:

an adder for adding said calibration signal produced in said time-division calibration signal producing unit to said transmission main signal for each of said antenna elements;

radio transmitters each provided for each of said antenna elements for frequency-converting a frequency of an inputted signal into said transmission radio frequency for outputting as a transmission signal to said antenna element; and a time-division demultiplexing unit for demultiplexing an output of said adder for each of said antenna elements for distribution to said radio transmitters.

6. The calibration apparatus for an array antenna according to claim 5, wherein said relative phase difference detecting means includes:

a time-division multiplexing unit for time-division-multiplexing an output of said reception means for each of said antenna elements;

a time-division calibration signal detecting unit for detecting said calibration signal from an output of said time-division multiplexing unit for each of said antenna elements in a time division fashion;

a time-division phase detecting unit for detecting a phase of each of said calibration signals detected by said time-division calibration signal detecting unit in a time-division fashion; and a time-division relative phase difference detecting unit for detecting said relative phase difference between said calibration signals on the basis of a result of each detection by said time-division phase detecting unit in a time division fashion.

7. The calibration apparatus for an array antenna according to claim 1, wherein said calibration signal producing means produces a fixed value as said calibration signal.

8. The calibration apparatus for an array antenna according to claim 1, wherein said calibration signal producing means produces a sine wave as said calibration signal.

9. The calibration apparatus for an array antenna according to claim 1, wherein said calibration signal producing means produces a spread spectrum signal as said calibration signal.

10. The calibration apparatus for an array antenna according to claim 9, wherein said calibration signal producing means is made to produce said spread spectrum signal which is spread with a different spread code for each of said antenna elements.

11. The calibration apparatus for an array antenna according to claim 1, wherein said array antenna has a transmission diversity arrangement.

12. The calibration apparatus for an array antenna according to claim 1, wherein said array antenna has a reception diversity arrangement.

13. The calibration apparatus for an array antenna according to claim 11, wherein said array antenna has a reception diversity arrangement.

14. The calibration apparatus for an array antenna according to claim 1, wherein each of said transmission main signal and said reception main signal is a signal in an FDMA (Frequency Division Multiple Access) system.

15. The calibration apparatus for an array antenna according to claim 1, wherein each of said transmission main signal and said reception main signal is a signal in a TDMA (Time Division Multiple Access) system.

16. The calibration apparatus for an array antenna according to claim 1, wherein each of said transmission main signal and said reception main signal is a signal in a CDMA (Code Division Multiple Access) system.

17. The calibration apparatus for an array antenna according to claim 1, wherein each of said transmission main signal and said reception main signal is a signal in a multicarrier transmission system.

18. A calibration method for an array antenna having a plurality of antenna elements, comprising the steps of:

producing a calibration signal for each of the antenna elements;

outputting, to said antenna element, the produced calibration signal together with a transmission main signal at a predetermined transmission radio frequency;

detecting said calibration signal from a signal directed at said antenna element and converting the detected calibration signal into a predetermined reception radio frequency to output the converted calibration signal, together with a reception main signal from said antenna element, to reception means;

detecting said calibration signal from an output of said reception means for each of said antenna elements to obtain a relative phase difference between said calibration signals; and correcting a phase difference with respect to one of or both said transmission main signal and said reception main signal on the basis of the obtained relative phase difference.

* * * * *